US009928780B2

(12) United States Patent
Wen

(10) Patent No.: US 9,928,780 B2
(45) Date of Patent: Mar. 27, 2018

(54) AMOLED DRIVING DEVICE

(71) Applicant: SHENZHEN CHINA STAR OPTOELECTRONICS TECHNOLOGY CO., LTD., Shenzhen, Guangdong (CN)

(72) Inventor: Yichien Wen, Guangdong (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 177 days.

(21) Appl. No.: 14/898,641

(22) PCT Filed: Oct. 29, 2015

(86) PCT No.: PCT/CN2015/093240
§ 371 (c)(1),
(2) Date: Dec. 15, 2015

(87) PCT Pub. No.: WO2017/070899
PCT Pub. Date: May 4, 2017

(65) Prior Publication Data

US 2017/0263189 A1 Sep. 14, 2017

(30) Foreign Application Priority Data

Oct. 27, 2015 (CN) ..... 2015 1 0706208

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2300/0408* (2013.01); *G09G 2310/027* (2013.01); *G09G 2310/08* (2013.01)

(58) Field of Classification Search
CPC ..... G09G 3/3291; G09G 3/3266; G09G 2300/0408; G09G 2310/027; G09G 2310/08
See application file for complete search history.

(56) References Cited

U.S. PATENT DOCUMENTS

2003/0117420 A1* 6/2003 Ando ..... G09G 3/20 345/690
2004/0061695 A1* 4/2004 Correa ..... G09G 3/2944 345/211
2005/0017778 A1* 1/2005 Nogawa ..... G09G 3/2014 327/165

(Continued)

FOREIGN PATENT DOCUMENTS

CN 102054427 A 5/2011
CN 103660468 A 3/2014
CN 103700348 A 4/2014

*Primary Examiner* — Sejoon Ahn
(74) *Attorney, Agent, or Firm* — Ladas & Parry LLP

(57) ABSTRACT

The present invention proposes an AMOLED driving device. The AMOLED device includes an AMOLED driving circuit, a scan driving signal source, a data driving signal source, and a data driving signal source control module. The AMOLED driving circuit includes a first semiconductor controllable switch, a second semiconductor controllable switch, an energy storage capacitor, and an organic light emitting diode.

11 Claims, 4 Drawing Sheets

(56) References Cited

U.S. PATENT DOCUMENTS

| | | | | |
|---|---|---|---|---|
| 2005/0057455 | A1* | 3/2005 | Peng | G09G 3/3283 345/76 |
| 2005/0146532 | A1* | 7/2005 | Miyazaki | G09G 3/2096 345/600 |
| 2006/0001784 | A1* | 1/2006 | Isono | G09G 3/2081 348/800 |
| 2011/0169882 | A1* | 7/2011 | Dallas | G02F 1/133553 345/691 |
| 2013/0009938 | A1* | 1/2013 | Hwang | G09G 3/348 345/212 |
| 2015/0130861 | A1 | 5/2015 | Lee et al. | |
| 2015/0161934 | A1 | 6/2015 | Chen et al. | |
| 2015/0187255 | A1 | 7/2015 | Wen et al. | |
| 2016/0188062 | A1* | 6/2016 | Jung | G06F 3/0412 345/173 |
| 2016/0372040 | A1* | 12/2016 | Huangfu | G09G 3/3258 |

* cited by examiner

AMOLED DRIVING DEVICE

FIELD OF THE INVENTION

The present invention relates to the field of electronic displays, and more particularly to an AMOLED driving device.

BACKGROUND OF THE INVENTION

With the improvement of process technology and material in flat panel displays, active-matrix organic light emitting diodes (AMOLED) have gradually become a mainstream choice for future display devices.

FIG. 1 shows an AMOLED driving circuit in the prior art, which comprises a first semiconductor controllable switch T1, a second semiconductor controllable switch T2, an energy storage capacitor C1, and an organic light emitting diode D1. A terminal of the second semiconductor controllable switch T2 is connected to a first controlling voltage VDD, and the other terminal is connected with an anode of the organic light emitting diode D1. A cathode of the organic light emitting diode D1 is connected to a second controlling voltage VSS. A source of the first semiconductor controllable switch T1 is connected to a data driving signal SN of an AMOLED display panel, a gate of the first semiconductor controllable switch T1 is connected to a scan driving signal GN of the AMOLED display panel, and a drain of the first semiconductor controllable switch T1 is connected to a gate of the second semiconductor controllable switch T2. The storage capacitor C1 is connected in series between the gate and source of the second semiconductor controllable switch T2, so that a saturation region is controlled by the second semiconductor controllable switch T2, thereby providing current to the AMOLED for emitting light.

In order to increase drive consistency of the AMOLED driving circuit, panel manufacturers provide a method using pulse width modulation to drive the AMOLED driving circuit (please refer to CN Patent Application No. 201410014397.X, titled "AMOLED driving circuit and driving method thereof"). By dividing a driving time in one frame of an organic light emitting diode into N sub-frame times, the influence of the storage capacitor C1 applied to the second semiconductor controllable switch T2 can be eliminated, but a transmission speed of a data driving signal at each sub-frame time should be relatively increased, so that data transmissions of the AMOLED driving circuit will be restricted by a transmission speed of a driver IC and an access speed of a storage.

Accordingly, it is necessary to provide an AMOLED driving device to solve the technical problem in the prior art.

SUMMARY OF THE INVENTION

An object of the present invention is to provide an AMOLED driving device for which there are low demands for a transmission speed of a driver IC and an access speed of a storage, so as to solve the problem that the prior art AMOLED driving device has high demands for a transmission speed of a driver IC and an access speed of a storage.

In order to solve the above-mentioned problem, the technical solution of the present invention is as follows.

The present invention provides an AMOLED driving device, comprising:

an AMOLED driving circuit comprising a first semiconductor controllable switch, a second semiconductor controllable switch, an energy storage capacitor, and an organic light emitting diode;

a scan driving signal source, for generating a scan driving signal;

a data driving signal source, for generating a data driving signal; and a data driving signal source control module, for controlling an operating mode of the data driving signal source, wherein the data driving signal is inputted into an input terminal of the first semiconductor controllable switch, the scan driving signal is inputted into a control terminal of the first semiconductor controllable switch; an output terminal of the first semiconductor controllable switch is connected with a control terminal of the second semiconductor controllable switch;

an input terminal of the second semiconductor controllable switch is connected with a first control voltage, an output terminal of the second semiconductor controllable switch is connected with an anode of the organic light emitting diode; a cathode of the organic light emitting diode is connected with a second control voltage; the storage capacitor is respectively connected with the input terminal of the second semiconductor controllable switch and the control terminal of the second semiconductor controllable switch;

when the data driving signal source is in a first operating mode, the data driving signal is generated by the data driving signal source by the following steps:

dividing grayscale values of each pixel of each frame into N portions, so as to obtain N PWM driving signals of the organic light emitting diode, where N is a positive integer greater than or equal to 1;

dividing a driving time of each frame of the organic light emitting diode into N sub-driving times, wherein one of the sub-driving times of each frame corresponds to one of the PWM driving signals; and transmitting all of the PWM driving signals of each frame to the organic light emitting diode at a corresponding sub-driving time, so as to drive and display an image;

when the data driving signal source is in a second operating mode, the data driving signal is generated by the data driving signal source by the following steps:

converting the grayscale values of each pixel of each frame into the PWM driving signals; and transmitting the PWM driving signals corresponding each frame to the organic light emitting diode at a corresponding driving time, so as to drive and display the image.

In the AMOLED driving device of the present invention, the grayscale values of each pixel of each frame are divided into N portions by bytes.

In the AMOLED driving device of the present invention, before the step of dividing grayscale values of each pixel of each frame into N portions, comprises:

representing grayscale values of each pixel of each frame in format of binary values.

In the AMOLED driving device of the present invention, the grayscale values of each pixel of each frame are divided into eight portions by bytes, and each PWM driving signal represents one byte of the grayscale values.

In the AMOLED driving device of the present invention, the step of dividing a driving time of each frame of the organic light emitting diode into N sub-driving times comprises:

dividing the driving time of each frame of the organic light emitting diode evenly into N sub-driving times; and the step of transmitting all of the PWM driving signals of each frame to the organic light emitting diode at a corresponding sub-driving time, so as to drive and display an image, comprises:

transmitting all of the PWM driving signals of each frame to the organic light emitting diode at the corresponding sub-driving time; and synthesizing all of the PWM driving signals of each frame to form the grayscale values of each pixel of each frame, so as to drive and display the image.

In the AMOLED driving device of the present invention, the step of generating the data driving signal by the data driving signal source comprises:

discharging the energy storage capacitor corresponding to the organic light emitting diode by a discharge signal after displaying each frame.

In the AMOLED driving device of the present invention, the PWM driving signal comprises a first start signal, a first clock signal, and a first enable signal; and the discharge signal comprises a second start signal, a second clock signal, and a second enable signal.

In the AMOLED driving device of the present invention, a range of the grayscale values of each pixel is between 0 and 255.

The present invention also provides an AMOLED driving device, comprising:

an AMOLED driving circuit comprising a first semiconductor controllable switch, a second semiconductor controllable switch, an energy storage capacitor, and an organic light emitting diode;

a scan driving signal source, for generating a scan driving signal;

a data driving signal source, for generating a data driving signal; and a data driving signal source control module, for controlling an operating mode of the data driving signal source, wherein the data driving signal is inputted into an input terminal of the first semiconductor controllable switch, the scan driving signal is inputted into a control terminal of the first semiconductor controllable switch; an output terminal of the first semiconductor controllable switch is connected with a control terminal of the second semiconductor controllable switch;

an input terminal of the second semiconductor controllable switch is connected with a first control voltage, an output terminal of the second semiconductor controllable switch is connected with an anode of the organic light emitting diode; a cathode of the organic light emitting diode is connected with a second control voltage; the storage capacitor is respectively connected with the input terminal of the second semiconductor controllable switch and the control terminal of the second semiconductor controllable switch In the AMOLED driving device of the present invention, when the data driving signal source is in a first operating mode, the data driving signal is generated by the data driving signal source by the following steps:

dividing grayscale values of each pixel of each frame into N portions, so as to obtain N PWM driving signals of the organic light emitting diode, where N is a positive integer greater than or equal to 1;

dividing a driving time of each frame of the organic light emitting diode into N sub-driving times, wherein one of the sub-driving times of each frame corresponds to one of the PWM driving signals; and transmitting all of the PWM (Pulse Width Modulation) driving signals of each frame to the organic light emitting diode at a corresponding sub-driving time, so as to drive and display an image.

In the AMOLED driving device of the present invention, the grayscale values of each pixel of each frame are divided into N portions by bytes.

In the AMOLED driving device of the present invention, before the step of dividing grayscale values of each pixel of each frame into N portions, comprises:

representing grayscale values of each pixel of each frame in format of binary values.

In the AMOLED driving device of the present invention, the grayscale values of each pixel of each frame are divided into eight portions by bytes, and each PWM driving signal represents one byte of the grayscale values.

In the AMOLED driving device of the present invention, the step of dividing a driving time of each frame of the organic light emitting diode into N sub-driving times comprises:

dividing the driving time of each frame of the organic light emitting diode evenly into N sub-driving times; and the step of transmitting all of the PWM driving signals of each frame to the organic light emitting diode at a corresponding sub-driving time, so as to drive and display an image, comprises:

transmitting all of the PWM driving signals of each frame to the organic light emitting diode at the corresponding sub-driving time; and synthesizing all of the PWM driving signals of each frame to form the grayscale values of each pixel of each frame, so as to drive and display the image.

In the AMOLED driving device of the present invention, the step of generating the data driving signal by the data driving signal source comprises:

discharging the energy storage capacitor corresponding to the organic light emitting diode by a discharge signal after displaying each frame.

In the AMOLED driving device of the present invention, the PWM driving signal comprises a first start signal, a first clock signal, and a first enable signal; and the discharge signal comprises a second start signal, a second clock signal, and a second enable signal.

In the AMOLED driving device of the present invention, a range of the grayscale values of each pixel is between 0 and 255.

In the AMOLED driving device of the present invention, when the data driving signal source is in a second operating mode, the data driving signal is generated by the data driving signal source by the following steps:

converting the grayscale values of each pixel of each frame into the PWM driving signals; and transmitting the PWM driving signals corresponding each frame to the organic light emitting diode at a corresponding driving time, so as to drive and display the image.

In comparison to the prior art AMOLED driving device, in an AMOLED driving device of the present invention, grayscale values of each pixel are divided, thereby decreasing a data size of each PWM driving signal, and demands for a transmission speed of a driver IC and an access speed of a storage are thus decreased, so as to solve the problem that the prior art AMOLED driving method has high demands for a transmission speed of a driver IC and an access speed of a storage.

In order to make the present invention more clear, preferred embodiments and the drawings thereof are described in detail below.

DETAILED DESCRIPTION OF THE INVENTION

Figure 1:
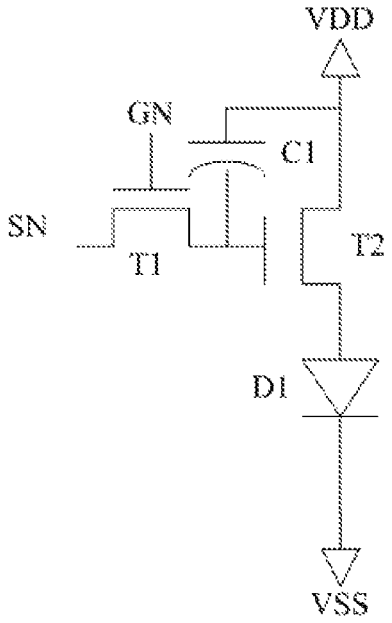
FIG. 1 (Prior Art)
FIG. 1 is a conventional AMOLED driving circuit.

The following embodiments refer to the accompanying drawings for exemplifying specific implementable embodiments of the present invention. Furthermore, directional terms described by the present invention, such as upper, lower, front, back, left, right, inner, outer, side, etc., are only directions by referring to the accompanying drawings, and thus the used directional terms are used to describe and understand the present invention, but the present invention is not limited thereto.

In the drawings, the same reference symbol represents the same or similar components.

Figure 2:
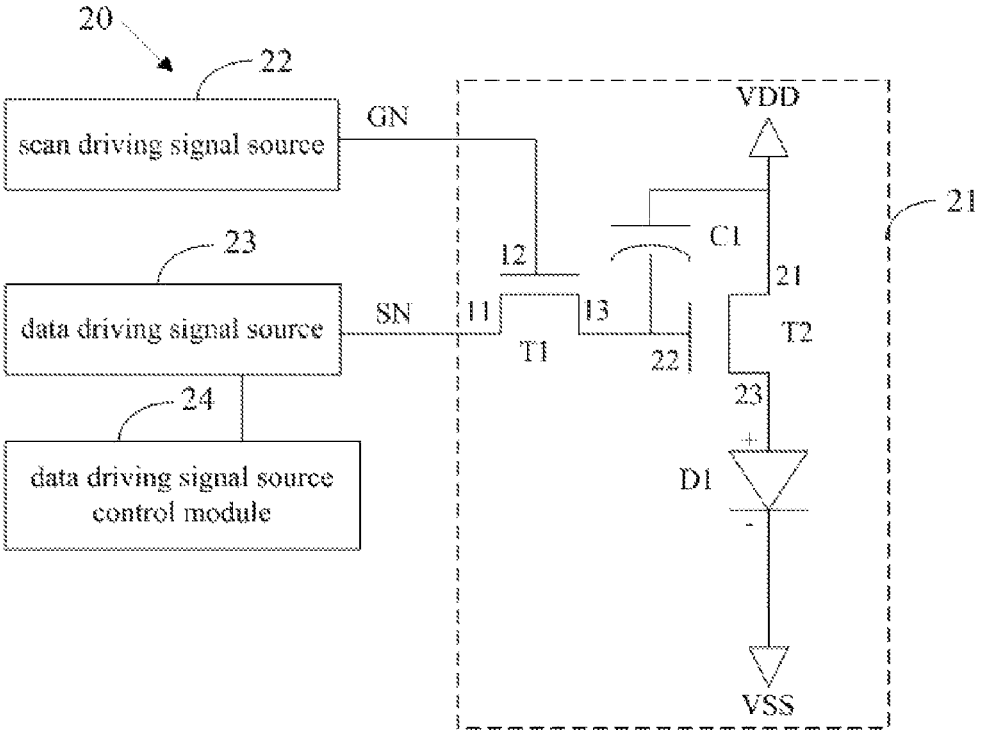
FIG. 2 is a structural diagram of an AMOLED driving device according to a preferred embodiment of the present invention.

Please refer to FIG. 2, which is a structural diagram of an AMOLED driving device according to a preferred embodiment of the present invention. In the present preferred embodiment, the AMOLED driving device 20 comprises an AMOLED driving circuit 21, a scan driving signal source 22, a data driving signal source 23, and a data driving signal source control module 24.

The AMOLED driving circuit 21 comprises a first semiconductor controllable switch T1, a second semiconductor controllable switch T2, an energy storage capacitor C1, and an organic light emitting diode D1. The scan driving signal source 22 is used for generating a scan driving signal GN. The data driving signal source 23 is used for generating a data driving signal SN. The data driving signal source control module 24 is used for controlling an operating mode of the data driving signal source.

The data driving signal SN is inputted into an input terminal 11 of the first semiconductor controllable switch T1. The scan driving signal GN is inputted into a control terminal 12 of the first semiconductor controllable switch T1. An output terminal 13 of the first semiconductor controllable switch T1 is connected with a control terminal 22 of the second semiconductor controllable switch T2. An input terminal 21 of the second semiconductor controllable switch T2 is connected with a first control voltage VDD. An output terminal 23 of the second semiconductor controllable switch T2 is connected with an anode of the organic light emitting diode D1. A cathode of the organic light emitting diode D1 is connected with a second control voltage VSS. The storage capacitor C1 is respectively connected with the input terminal 21 of the second semiconductor controllable switch T2 and the control terminal 22 of the second semiconductor controllable switch T2.

In the AMOLED driving device 20 of the preferred embodiment of the present invention, the data driving signal source 23 includes two operating modes, under a control of the data driving signal source control module 24. When the data driving signal source 23 is in a first operating mode, the data driving signal source 23 divides the grayscale values of each pixel and then converts these to a plurality of PWM driving signals (i.e., data driving signals), thereby effectively decreasing a data size of the data driving signal.

When the data driving signal source 23 is in a second operating mode, the data driving signal source 23 directly converts the grayscale values of each pixel to the PWM driving signals, so it achieves a rapid conversion of the driving signals.

Therefore, in the AMOLED driving device 20 of the preferred embodiment of the present invention, a corresponding driving signal conversion method can be chosen according to the user's display needs. On the basis of ensuring a display quality, demands for a transmission speed of a driver IC and an access speed of a storage are decreased.

The operating theory of the data driving signal source under each operating mode in the AMOLED driving device of the present preferred embodiment is described in detail below.

Figure 3:
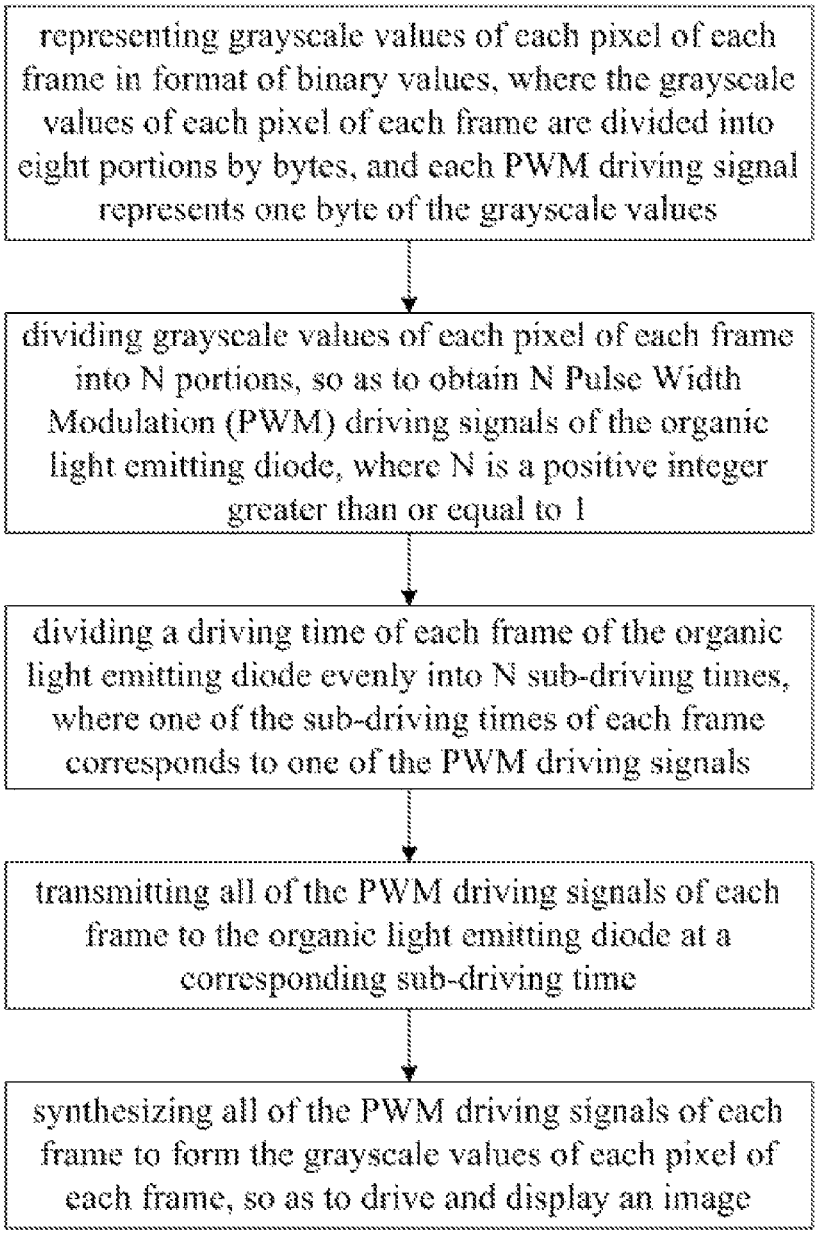
FIG. 3 is a flowchart of the data driving signal source in a first operating mode.

Refer to FIG. 3, which is a flowchart of the data driving signal source in a first operating mode. When the data driving signal source 23 is in a first operating mode, the data driving signal source 23 firstly uses binary values to represent the grayscale values of each pixel of each frame. Since a range of the grayscale values of two pixels is between 0 and 255, the range of the grayscale values is between 0 and 11111111.

Then, the grayscale values of each pixel of each frame are divided into N portions by the data driving signal source 23, so as to obtain N PWM driving signals of the organic light emitting diode. To be specific, the grayscale values of each pixel of each frame are divided into eight portions by bytes, and each PWM driving signal represents one byte of the grayscale values.

Then, the driving time of each frame of the organic light emitting diodes is evenly divided into N sub-driving times by the scan driving signal source 22, so as to be effectively displayed by the organic light emitting diode using each PWM driving signal.

The data driving signal source 23 transmits all of the PWM driving signals of each frame to the organic light emitting diode D1 at a corresponding sub-driving time which is determined by the scan driving signal source 22, so as to display and drive the image.

Specifically, all of the PWM driving signals of each frame are firstly transmitted to the organic light emitting diode D1 at the corresponding sub-driving time by the data driving signal source 23. That is, each PWM driving signal comprises a first start signal, which is used for controlling starting of the PWM driving signal, a first clock signal, which is used for controlling the time of the PWM driving signal, and a first enable signal, which is used for controlling outputting of the PWM driving signal. Since one byte of the grayscale values can only be 1 or 0, the PWM driving signal only comprises two statuses which are a high level driving signal and a low level driving signal, which are used to respectively represent 0 or 1.

Then, all of the PWM driving signals of each frame are synthesized by the organic light emitting diode D1, so that the grayscale values of each pixel of each frame are formed, so as to drive and display the image.

Finally, after displaying each frame, the energy storage capacitor C1 corresponding to the organic light emitting diode D1 is discharged by the data driving signal source 23 using a discharge signal, so that the influence of the storage capacitor C1 applied to the image display can be effectively eliminated. The discharge signal comprises a second start signal, which is used for controlling starting of the discharge signal, a second clock signal, which is used for controlling the time of the discharge signal, and a second enable signal, which is used for controlling outputting of the discharge signal.

Figure 4:
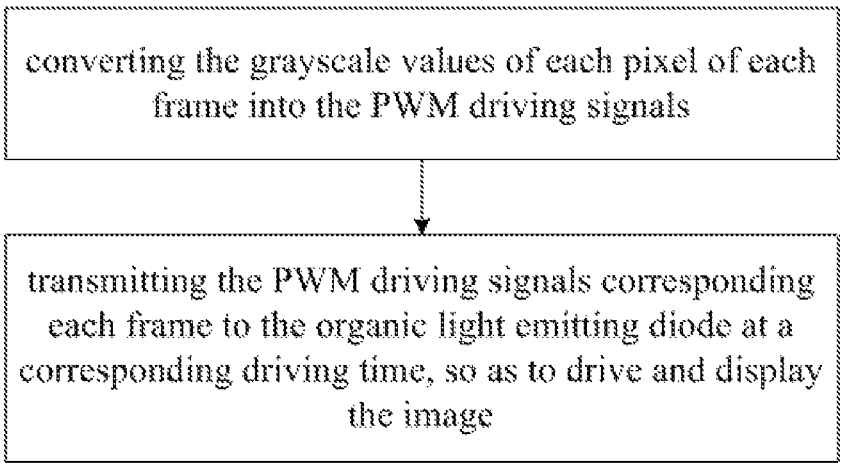
FIG. 4 is a flowchart of the data driving signal source in a second operating mode.

Refer to FIG. 4, which is a flowchart of the data driving signal source in a second operating mode. When the data driving signal source 23 is in a second operating mode, the data driving signal source 23 directly converts the grayscale values of each pixel of each frame to the PWM driving signals. Then, the data driving signal source 23 transmits the PWM driving signals corresponding to each frame to the organic light emitting diode D1 at a corresponding driving time which is determined by the scan driving signal source 22. Since there is no need to divide the grayscale values of each pixel, a generation speed of the PWM driving signals is faster, thereby achieving a faster conversion speed of the PWM driving signals.

Therefore, the image driving process by the AMOLED driving device 20 of the present preferred embodiment is accomplished.

In the AMOLED driving device of the present invention, by dividing the grayscale values of each pixel, a data size of each PWM driving signal is decreased, thereby decreasing the demands for a transmission speed of a driver IC and an access speed of a storage, so as to solve the problem that the prior art AMOLED driving device has high demands for a transmission speed of a driver IC and an access speed of a storage.

In summary, the above descriptions are merely preferred embodiments of the present invention, and are not intended to limit the scope of the present invention. Any modification or replacement made by those skilled in the art without departing from the spirit and principle of the present invention should fall within the protection scope of the present invention. Therefore, the protection scope of the present invention is subject to the appended claims.

What is claimed is:

1. An active-matrix organic light emitting diode (AMOLED) driving device, comprising:

an AMOLED driving circuit including a first semiconductor controllable switch, a second semiconductor controllable switch, an energy storage capacitor, and an organic light emitting diode, wherein a data driving signal is inputted into an input terminal of the first semiconductor controllable switch, a scan driving signal is inputted into a control terminal of the first semiconductor controllable switch; an output terminal of the first semiconductor controllable switch is connected with a control terminal of the second semiconductor controllable switch;

an input terminal of the second semiconductor controllable switch is connected with a first control voltage, an output terminal of the second semiconductor controllable switch is connected with an anode of the organic light emitting diode; a cathode of the organic light emitting diode is connected with a second control voltage; the storage capacitor is respectively connected with the input terminal of the second semiconductor controllable switch and the control terminal of the second semiconductor controllable switch;

when a data driving signal source is in a first operating mode, the data driving signal is generated by the data driving signal source by the following steps:

dividing grayscale values of each pixel of each frame into N portions, so as to obtain N Pulse Width Modulation (PWM) driving signals of the organic light emitting diode, where N is a positive integer greater than or equal to 1;

dividing a driving time of each frame of the organic light emitting diode into N sub-driving times, wherein one of the sub-driving times of each frame corresponds to one of the PWM driving signals;

transmitting all of the PWM driving signals of each frame to the organic light emitting diode at a corresponding sub-driving time; and synthesizing all of the PWM driving signals of each frame to form the grayscale values of each pixel of each frame, so as to drive and display an image;

when the data driving signal source is in a second operating mode, the data driving signal is generated by the data driving signal source by the following steps;

converting the grayscale values of each pixel of each frame into the PWM driving signals; and transmitting the PWM driving signals corresponding each frame to the organic light emitting diode at a corresponding driving time, so as to drive and display the image, wherein grayscale values of each pixel of each frame are represented in binary value format, wherein the grayscale values of each pixel of each frame are divided into eight byte portions, and each PWM driving signal represents one byte of the grayscale values.

2. The AMOLED driving device as claimed in claim 1, wherein the grayscale values of each pixel of each frame are divided into N portions by bytes.

3. The AMOLED driving device as claimed in claim 1, wherein the step of generating the data driving signal by the data driving signal source comprises: discharging the energy storage capacitor corresponding to the organic light emitting diode by a discharge signal after displaying each frame.

4. The AMOLED driving device as claimed in claim 3, wherein the PWM driving signal comprises a first start signal, a first clock signal, and a first enable signal; and the discharge signal comprises a second start signal, a second clock signal, and a second enable signal.

5. The AMOLED driving device as claimed in claim 1, wherein a range of the grayscale values of each pixel is between 0 and 255.

6. An active-matrix organic light emitting diode (AMOLED) driving device, comprising:

an AMOLED driving circuit including a first semiconductor controllable switch, a second semiconductor controllable switch, an energy storage capacitor, and an organic light emitting diode, wherein a data driving signal is inputted into an input terminal of the first semiconductor controllable switch, a scan driving signal is inputted into a control terminal of the first semiconductor controllable switch; an output terminal of the first semiconductor controllable switch is connected with a control terminal of the second semiconductor controllable switch;

an input terminal of the second semiconductor controllable switch is connected with a first control voltage, an output terminal of the second semiconductor controllable switch is connected with an anode of the organic light emitting diode; a cathode of the organic light emitting diode is connected with a second control voltage; the storage capacitor is respectively connected with the input terminal of the second semiconductor controllable switch and the control terminal of the second semiconductor controllable switch, wherein when a data driving signal source is in a first operating mode, the data driving signal is generated by the data driving signal source by the following steps:

dividing the grayscale values of each pixel of each frame arc divided into N portions, so as to obtain N Pulse Width Modulation (PWM) driving signals of the organic light emitting diode, where N is a positive integer greater than or equal to 1;

dividing a driving time of each frame of the organic light emitting diode into N sub-driving times, wherein one of the sub-driving times of each frame corresponds to one of the PWM driving signals;

transmitting all of the PWM driving signals of each frame to the organic light emitting diode at a corresponding sub-driving time; and synthesizing all of the PWM driving signals of each frame to form the grayscale values of each pixel of each frame, so as to drive and display an image, wherein grayscale values of each pixel of each frame are represented in binary value format, wherein the grayscale values of each pixel of each frame are divided into eight byte portions, and each PWM driving signal represents one byte of the grayscale values.

7. The AMOLED driving device as claimed in claim 6, wherein the grayscale values of each pixel of each frame are divided into N portions by bytes.

8. The AMOLED driving device as claimed in claim 6, wherein the step of generating the data driving signal by the data driving signal source comprises:

discharging the energy storage capacitor corresponding to the organic light emitting diode by a discharge signal after displaying each frame.

9. The AMOLED driving device as claimed in claim 8, wherein the PWM driving signal comprises a first start signal, a first clock signal, and a first enable signal; and the discharge signal comprises a second start signal, a second clock signal, and a second enable signal.

10. The AMOLED driving device as claimed in claim 6, wherein a range of the grayscale values of each pixel is between 0 and 255.

11. The AMOLED driving device as claimed in claim 6, wherein when the data driving signal source is in a second operating mode, the data driving signal is generated by the data driving signal source by the following steps:

converting the grayscale values of each pixel of each frame into the PWM driving signals; and transmitting the PWM driving signals corresponding each frame to the organic light emitting diode at a corresponding driving time, so as to drive and display the image.

* * * * *